United States Patent [19]

Ross

[11] Patent Number: 5,010,463

[45] Date of Patent: Apr. 23, 1991

[54] ELECTRIFIED BULLETIN BOARD WITH ILLUMINABLE PUSH-PIN

[76] Inventor: David L. Ross, 2 Ridgemore Dr., Ann Arbor, Mich. 48103

[21] Appl. No.: 516,477

[22] Filed: Apr. 30, 1990

[51] Int. Cl.[5] ..... F21V 33/00

[52] U.S. Cl. ..... 362/253; 362/226; 362/234; 362/800; 40/452; 439/45

[58] Field of Search ..... 362/226, 234, 239, 250, 362/251, 253, 800, 806, 249; 40/452; 439/45, 52

[56] References Cited

U.S. PATENT DOCUMENTS 3,452,456 7/1969 Tinman ..... 40/452 X 4,920,467 4/1990 Honsberger ..... 362/800 X

*Primary Examiner*—Stephen F. Husar

*Attorney, Agent, or Firm*—Harness, Dickey & Pierce

[57] ABSTRACT

The present invention is an electrified bulletin board display assembly including a composite board and an illuminable push-pin for insertion therein. The board itself includes a pair of conducting layers spaced apart by an insulative layer and connected to an electrical power source. When inserted into the bulletin board, bi-terminals of the push-pin each respectively contacts one of the conductive layers. An additional layer is provided in the board to retain the push-pin in the assembly and ensure contact between the conductive layers and the bi-terminals. As constructed, the entire field of the bulletin board is capable of receiving and illuminating a number of illuminable push-pins randomly inserted therein.

18 Claims, 2 Drawing Sheets

ELECTRIFIED BULLETIN BOARD WITH ILLUMINABLE PUSH-PIN

BACKGROUND AND SUMMARY OF THE INVENTION

The present invention generally relates to the field of bulletin boards. More particularly, the invention pertains to a highlighted display assembly wherein notices, activities, locations and other information may be electrically highlighted by the insertion of an illuminable push-pin into the bulletin board. The entire field of the bulletin board is constructed so as to allow the push-pins to be randomly inserted into the board. Thus, the board contains no "dead spots" or other portions not capable of illuminating a push-pin.

The common bulletin board is generally little more than a sheet of retaining material, most often cork, mounted upon a rigid back board and possibly secured by a peripheral frame. A bulletin board may incorporate a support structure to give it free standing capabilities, but generally, the board will be mounted on a wall.

It is therefore an object of the present invention to provide an electrified bulletin board wherein illuminable push-pins will illuminate upon random insertion into the board surface.

It is a further object of the present invention to provide an electrified bulletin board in which traditional push-pins or thumb tacks may be inserted without causing damage or short circuits therein.

Still another object of the present invention is to provide an electrified bulletin board wherein illuminable push-pins may be associated with any printed information posted or incorporated onto the board surface. Thus, the information is not required to be in any particular format and may be subsequently and easily changed to meet the needs and desires of the particular user.

An additional object of the present invention is to provide an electrified bulletin board capable of being easily mounted on a standard home or office wall.

The electrified bulletin board of the present invention is constructed so as to provide for safe, easy and inexpensive operation. Generally, the construction may be described as being of a composite or laminated nature. The backmost layer is a rigid backboard which enables the assembly to be mounted on a wall or secured to a stand. Proceeding outwardly from the backboard, a thin conductive layer carries the positive voltage for the assembly. Over this positive conducting layer is positioned an electrically insulative material. Exterior to the insulative material is another thin conductive layer. This conductive layer, however, acts as the negative lead of the voltage. The negative conductive layer is then covered by a relatively thick foam layer. The foam must be rigid enough to support the inserted illuminable push-pins and thick enough to prevent the substantial majority of pin-type tacking means from penetrating into the negative conducting layer. The outermost layer is a display surface which may be constructed of a thin cork, cardboard or other visually enhancing material. All of the layers are secured together by adhesive, an exterior frame or other means.

In operating the present invention, a low voltage electrical current is supplied to the board via the conductive layers. Upon insertion of an illuminable push-pin, contact is made between the two conductive layers of the assembly and the electrical circuit is closed. In this manner, an illumination element located in the push-pin will be caused to emit light.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE DRAWINGS

Figure 1:
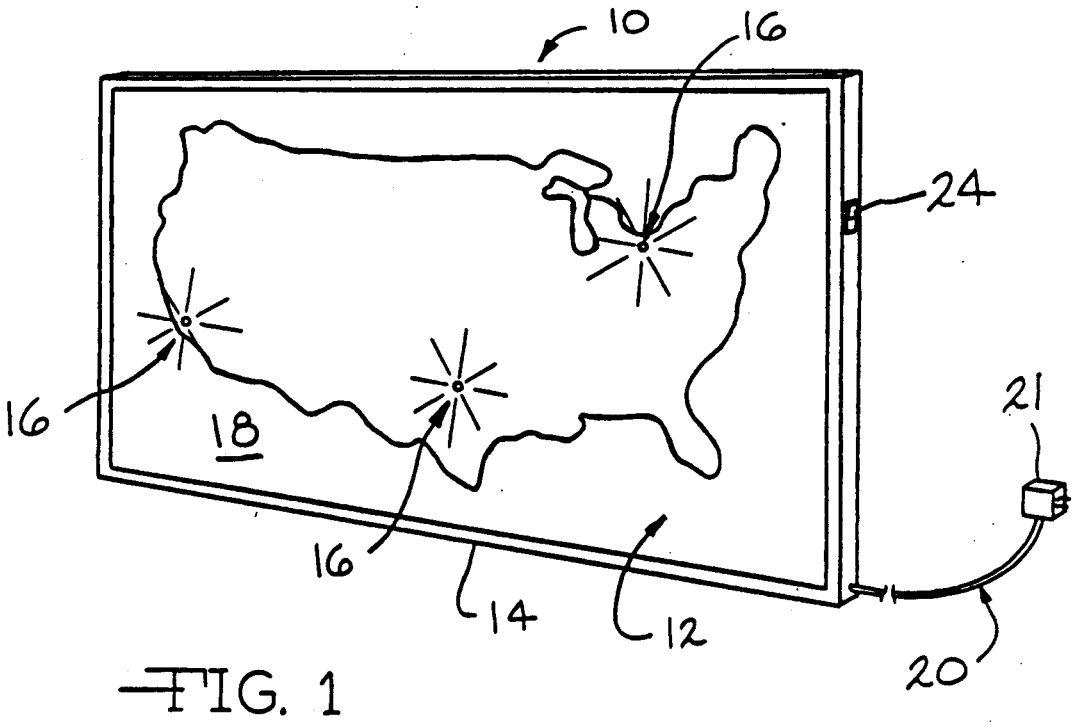
FIG. 1 is a perspective view of one embodiment of the electrified bulletin board assembly of the present invention.

Now with reference to the drawing, an electrified bulletin board assembly, constructed according to the principles of the present invention, is shown in FIG. 1 and is generally designated as 10.

A series of layered materials are adhesively or otherwise secured together to form a laminated board 12. The laminated board may further be enclosed and secured along its peripheral edges by a frame 14. A number of illuminable push-pins 16 are shown randomly inserted and positioned on the display surface 18 of the assembly 10. These photo-emissive push-pins 16 will illuminate upon electricity being supplied to the bulletin board assembly 10 through an electrical cord 20. The electrical cord 20 is adapted to be plugged into a standard 110 volt electrical outlet. To ensure safe operation of the assembly 10, a transformer 22 and rectifier 23, housed within an electrical plug 21, are employed to convert the standard AC voltage into a lower DC voltage, preferably 6 volts. The assembly 10 is also provided with a ON/OFF switch 24 and a thermal cutoff or fuse 26 to prevent damage to the circuitry.

In the present embodiment of the invention, the laminated board 12 consists of six distinct layers. However, a greater or lesser number of laminae might also be employed.

The exterior and visual layer of the board 12 is the display surface 18 of the assembly 10. The display surface 18 is generally constructed of thin cork but may also be constructed from other penetrable materials such as a heavy weight paper or cardboard. The surface 18 itself can be finished to display virtually anything desired by the operator of the assembly 10, including maps, charts, schedules, information of a changing status, the operational status of machines or facilities, equipment location, personnel location, personnel availability, fund raising achievement levels and other displays designed to convey information and/or artistic impressions.

The second layer 32 is thicker and more rigid than the display surface 18. Like the display surface 18, it is penetrable by various pin-type tacking means including common thumb tacks 28 and the illuminable push-pin 16 which is further described below. The rigidity of the second layer 32 must be such that, while permitting insertion of the push-pins 16, it also adequately supports and retains the push-pins 16 in the assembly 10. By way of illustration and not limitation, materials which satisfy these requirements include cork, foam and other materials of the like characteristics.

Figure 2:
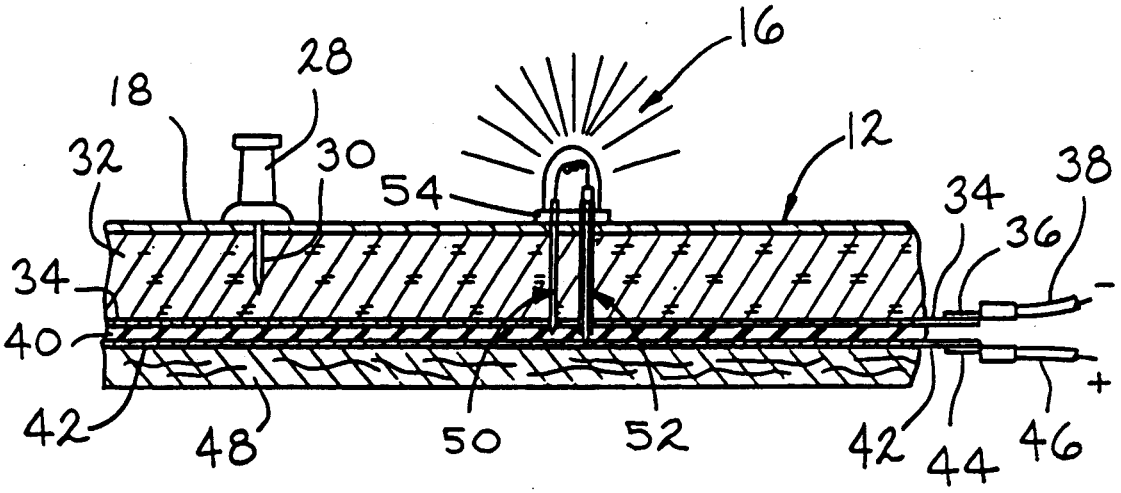
FIG. 2 is an enlarged sectional view of the present invention illustrating the contacting position of an illuminating push-pin inserted therein.

As seen in FIG. 2, the first two laminated layers 18 and 32 provide sufficient thickness to prevent the pin 30 of a majority of pin-type tacking means from contacting or interfering with the electrical circuitry (further described below) of the assembly 10. Generally, a depth greater than ⅛ of an inch would be sufficient to allow the common thumb tack 28 to be used in conjunction with the present invention without penetration into any of the subsequent layers.

A third layer 34 (hereinafter the first foil layer 34) is constructed of a thin conductive material such as aluminum foil. The first foil layer 34 must be thin enough to be easily pierced by a pair of contact terminals 50 and 52 of the illuminable push-pin 16. A small connecting plate 36 is fastened to the first foil layer 34 by a conductive adhesive and the additional pressure exerted by the laminated surfaces and the frame 14. A negative lead 38 of the electrical chord 20 is soldered to the connecting plate 36 to complete one half of the circuit of the assembly 10.

A second foil layer 42 is separated from the first foil layer 34 by a thin rigid sheet of electrically insulative material 40. This fourth layer primarily has two purposes. One is to electrically insulate the first foil layer 34 from the second foil layer 42. The second purpose is to provide enough resistive pressure to retain the displaced foil against the contact terminal 50 of the push-pin 16 thereby ensuring an adequate electrical connection.

The second foil layer 42 is similar or substantially identical to that of the first foil layer 34. In like fashion, the second foil layer 42 is fastened by a conductive adhesive to a second connecting plate 44 which is in turn soldered to the positive lead 46 of the electrical cord 20. The contact terminal 52 may penetrate through the second foil layer 42 and into a sixth layer. However, as long as adequate contact is made between the contact terminal 52 and the second foil layer 42, penetration may not be required.

The sixth and rearmost layer of the assembly 10 is a substantially rigid backboard 48. The backboard 48 provides structural rigidity to the assembly 10 and may additionally have the frame 14 fastened to it. A bracket for mounting the assembly 10 on a wall may be attached to either the backboard 48 or the perimeter frame 14. Likewise, a support structure could also be attached to the frame 14 to give the bulletin board 10 free standing capabilities.

Figure 3:
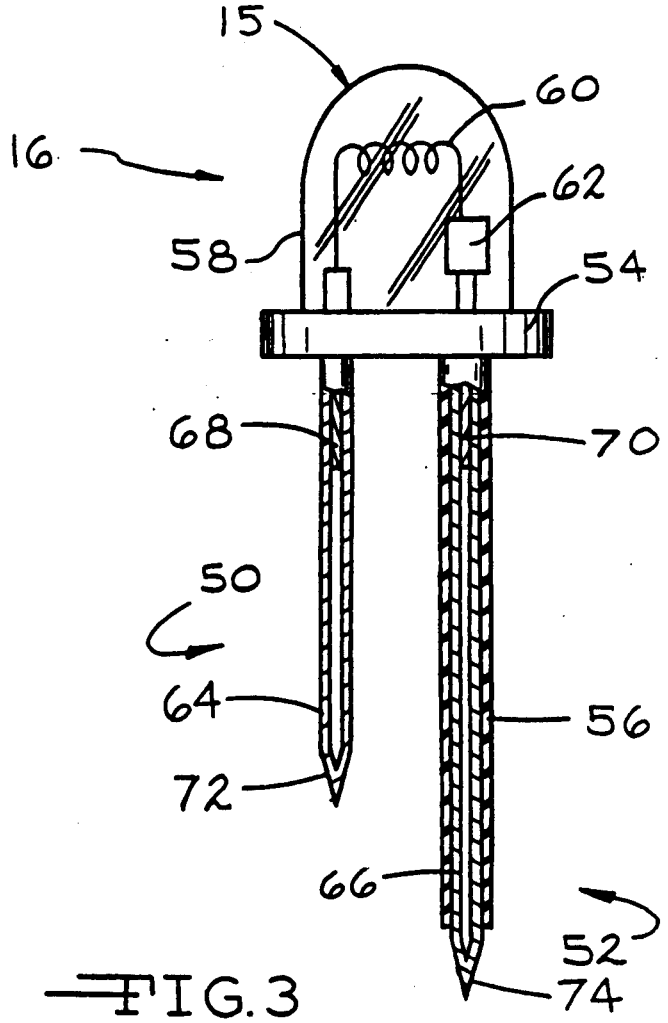
FIG. 3 is a perspective view of one embodiment of an illuminable push-pin for use in conjunction with the present invention.

When electricity is supplied to the assembly 10, an illuminable push-pin 16 that has been inserted into the display surface 18 will "light-up" and highlight information on the board 12. One embodiment of an illuminable push-pin 16 is shown in FIG. 3.

The illuminable push-pin 16 is generally of a bi-terminal construction, one contact terminal functioning as a ground terminal 50 and the other as a positive terminal 52. Both the ground terminal 50 and the positive terminal 52 are similarly constructed. One readily observed difference is that the ground terminal 50 is approximately two-thirds of the length of the positive terminal 52. This shorter length permits the ground terminal 50 to penetrate through the first three layers of the board 12 and only partially into the insulative sheet 40 of the fourth layer.

A lamp base 54 prevents over insertion of the push-pins 16 by coming into contact with the display surface 18. The lamp base 54 prohibits the ground terminal 50 from contacting both the first and second foil layers 34 and 42 and thereby short circuiting the assembly 10.

As stated previously, the positive terminal 52 is longer in length than the ground terminal 50. Upon insertion of an illuminable push-pin 16 into the board 12, the positive terminal 52 contacts, and possibly penetrates, the second foil layer 42. So long as an adequate electrical contact is made between the positive terminal 52 and the second foil layer 42, penetration of the second foil layer 42 is not required. Another distinction between the ground terminal 50 and the positive terminal 52 is that the positive terminal 52 is predominantly enclosed within an insulative sheath 56. The sheath 56 extends along the terminal 52 from the lamp base 54 to a depth approximating the middle of the insulative layer 40. In this manner, the positive terminal 52 is insulated and prevented from electrically contacting the first foil layer 34.

A detailed illustration of the construction of the terminals 50 and 52 is shown in FIG. 3. Each terminal consists of a hollow needle 64 and 66 respectively mounted over a bi-pin leg 68 and 70 extending downward from the lamp base 54. The hollow needles 64 and 66 are fastened by adhesive (not shown) or other means to the legs 68 and 70 in such a manner that will ensure electrical contact between the needles 64 and 66 and the legs 68 and 70. Suitable adhesives for ensuring such a connection include the conductive glues commercially sold in the market.

The hollow needles 64 and 66 are beneficial in several regards. First, the needles 64 and 66 enable the lengths of the terminals 50 and 52 to be more easily and accurately controlled during production of the illuminable push-pins 16. Secondly, the needles 64 and 66 further increase the structural rigidity of each terminal 50 and 52. Finally, each needle 64 and 66 may be provided with a sharp point 72 and 74 to assist and encourage penetration through and contact with the various layers of the laminated board 12.

Connected to the lamp base 54 is a transparent or translucent housing 58. The housing 68 may be of a unitary construction with the base 54 or it may be constructed separately fastened to the lamp base 54. The housing 58 encloses the photo emissive components of the illuminating push-pin 16. While the illustrated push-pin 16 of FIG. 3 is shown in an incandescent variety 15, the push-pins 16 could also be constructed as a light emitting diode (LED) variety 17 or the like. If desired, the housing 58 could also be tinted with color to further enhance the assembly 10.

Referring again to FIG. 3, enclosed within the housing 58 of the incandescent push-pin 15 is a resistor 62 and a filament 60. The resistor 62 restricts the amount of current drawn by the push-pin 15 and thereby allows a multiplicity inserted push-pins 15 to emit approximately the same amount of light, up to the capacity of the power supply A push-pin 16 might also be constructed without the resistor 62. When done in this manner, the inherent resistance of the filament 60 or other photo emissive component is used to control the amount of light emitted by each push-pin 16.

Figure 4:
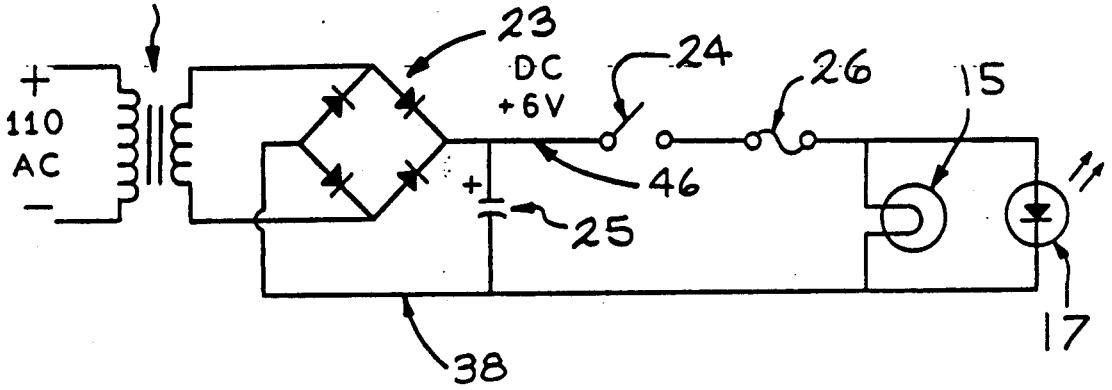
FIG. 4 is a schematic diagram of the electrical circuit generally involved in the present invention.

FIG. 4 schematically illustrates the basic circuitry of the present invention. A step-down transformer 22 converts the 110 volt AC power supply into a voltage slightly greater than the desired 6 volts. A full wave bridge rectifier 23 then converts the alternating current into direct current and, due to inherent losses in the rectifier 23, a preferred voltage of 6 volts DC is provided to the laminated board 12 by the leads 38 and 46 of the electrical cord 20. An in line ON/OFF switch 24 may be provided on the positive voltage lead 46 to turn the assembly 10 "ON" or "OFF". When the switch 24 is in the "OFF" position, the assembly 10 can operate as a standard bulletin board. To protect against current overloading, a thermal cutoff or fuse 26 is provided in the circuit.

Once inserted into the board 12, the illuminable push-pins 16 are connected in a parallel circuit to one another. This is illustrated in FIG. 4 which also displays both the LED 17 and incandescent 15 varieties of push-pins 16. The circuit incorporates a capacitor 25 to smooth the DC voltage.

While the assembly has been described as being "plugged into" a common electrical outlet, it is readily seen that the electrical power may be supplied by a battery or other source of electricity.

The disclosed bulletin board assembly 10 permits the illuminable push-pins 16 to be randomly and easily inserted into any location on the board 12 for illumination. Removal of the push-pins 16 is likewise easily achieved. Merely grasping the housing 58 and gently pulling the push-pin 16 is all that is required.

While the above description constitutes the preferred embodiments of the present invention, it will be appreciated that the invention is susceptible to modification, variation and change without departing from the proper scope and fair meaning of the accompanying claims.

I claim:

1. An electrified display assembly adapted for connection to an electrical power source and comprising:

a penetrable display board having a plurality of substrate layers including a first conductive layer spaced apart from a second conductive layer;

a retaining layer being positioned to one side of said conductive layers and being of a sufficient thickness to thereby prevent a substantial majority of pin-type tacking means from contacting said conductive layers when inserted into said assembly through said retaining layer;

means for conducting said conductive layers to an electrical potential; and means for illumination capable of being randomly mounted onto said board so as to thereby electrically contact said conductive layers and induce said illumination means to emit light, said retaining layer supporting and retaining said illumination means in said assembly.

2. An electrified display assembly as set forth in claim 1 wherein said board further includes an electrically insulative layer between said conductive layers.

3. An electrified display assembly as set forth in claim 1 wherein said illumination means includes a photo emissive component and a pair of contact terminals, said contact terminals penetrating and being inserted into said board upon the mounting of said illumination means to said board, one of said contact terminals contacting one of said conductive layers and the other of said contact terminals contacting the other of said conductive layers upon insertion into said board.

4. An electrified display assembly as set forth in claim 3 wherein said photo emissive component is a light emitting diode.

5. An electrified display assembly as set forth in claim 3 wherein said photo emissive component is an incandescent bulb.

6. An electrified display assembly as set forth in claim 3 wherein said pair of contact terminals include a short contact terminal for contacting said first conductive layer and a long contact terminal for contacting said second conductive layer and further including a means for preventing said long contact terminal and said short contact terminal from simultaneously contacting one of said conductive layers.

7. An electrified display assembly as set forth in claim 6 wherein said preventing means includes a sheath of insulative material enclosing a portion of said long contact terminal and preventing contact between said long contact terminal and said first conductive layer.

8. An electrified display assembly as set forth in claim 1 wherein said conductive layers are constructed of thin sheets of metallic foil.

9. An electrified display assembly as set forth in claim 1 wherein said connecting means includes an electrical cord having a first lead attached to said first conductive layer and a second lead attached to said second conductive layer, said electrical cord further having a plug adapted for insertion into a corresponding electrical outlet.

10. An electrified display assembly as set forth in claim 9 wherein said connecting means further includes a step-down transformer and a full wave bridge rectifier.

11. An electrified bulletin board display assembly adapted for connection to an electrical power source and comprising:

a penetrable composite display board including a first conductive layer, an insulative layer, and a second conductive layer, said first conductive layer being spaced apart from said second conductive layer by said insulative layer;

means for connecting said conductive layers to said power source; and at least one irradiate push-pin adapted for random positioning and substantially transverse insertion into said display board, said push-pin including a photo emissive portion having contact pins conductively and securely attached to a first contact terminal including a hollow needle and a second contact terminal including a hollow needle, whereby on insertion of said push-pin into said board said first contact terminal engages said second conductive layer thereby enabling said photo emissive portion to emit light.

12. An electrified bulletin board display assembly as set forth in claim 11 wherein said composite display board further includes a display surface, a backboard layer and a retaining layer for supporting and retaining said irradiate push-pin in said display board.

13. An electrified bulletin board display assembly as set forth in claim 11 wherein said photo emissive component is an incandescent bulb.

14. An electrified bulletin board display assembly as set forth in claim 11 wherein said photo emissive component is a light emitting diode (LED).

15. An electrified bulletin board display assembly as set forth in claim 11 wherein said second contact terminal is greater in length than said first contact terminal and includes an insulative sheath enclosing a portion of said second contact terminal to prevent simultaneous contact between said first conductive layer, said first contact terminal and said second contact terminal.

16. An illuminating display assembly adapted for connection to an electrical power source, said assembly including:

a penetrable composite display board having a display surface and a plurality of laminated layers including a retaining layer, a negative conductive layer, a positive conductive layer and an insulative layer separating said negative and positive conductive layers;

means for providing electrical current to said conductive layers; and means for illumination adapted for random positioning and insertion into said display board, said illumination means being secured and retained in said board by said retaining layer, said illumination means including a pair of contact pins being individually penetrable into said display board in spaced apart relation, said contact pins contacting said positive and negative conductive layers and said illumination means thereby causing to emit light.

17. An illuminating display assembly as set forth in claim 16 wherein said positive and negative conductive layers are constructed of thin metallic sheets substantially permitting penetration therethrough by said contact pins.

18. An illuminating display assembly as set forth in claim 16 wherein said illumination means further includes a photo emissive portion connected to said contact pins, said contact pins being negative and positive contact terminals for respectively contacting said negative and positive conductive layers, said illumination means further including means for preventing said positive contact terminal and said negative contact terminal from simultaneously contacting one of said conductive layers.

* * * * *